US005730068A

United States Patent [19]

Rioux, Jr.

[11] Patent Number: 5,730,068

[45] Date of Patent: Mar. 24, 1998

[54] DISPLAY TABLE

[76] Inventor: Robert A. Rioux, Jr., 6175 Crestview Dr., North Syracuse, N.Y. 13212

[21] Appl. No.: 770,950

[22] Filed: Jan. 2, 1997

[51] Int. Cl.[6] ..... A47B 57/00

[52] U.S. Cl. ..... 108/99; 108/92; 108/3

[58] Field of Search ..... 108/90, 92, 1, 108/3, 27, 26, 100; 211/149, 150, 130, 132, 208, 36, 38

[56] References Cited

U.S. PATENT DOCUMENTS 1,896,604 2/1933 Bales ..... 108/100

3,827,376 8/1974 Solomon ..... 211/149 X 4,332,611 6/1982 Shanok et al. ..... 108/27 X 5,199,360 4/1993 Koistinen ..... 108/3

5,590,796 1/1997 Herman ..... 108/99 X

*Primary Examiner*—Jose V. Chen

*Attorney, Agent, or Firm*—Wall Marjama & Bilinski

[57] ABSTRACT

A table for displaying produce and baked goods and the like that includes a base and a tiltable table top pivotally mounted in the base. A series of collapsible shelves are pivotally mounted in the table top and are controlled by a detachable linkage so that the shelves remain in a horizontal position when the table top is tilted. Detaching the linkage allows the shelves to lie flat against the table top when the table top is tilted.

14 Claims, 3 Drawing Sheets

FIG.6
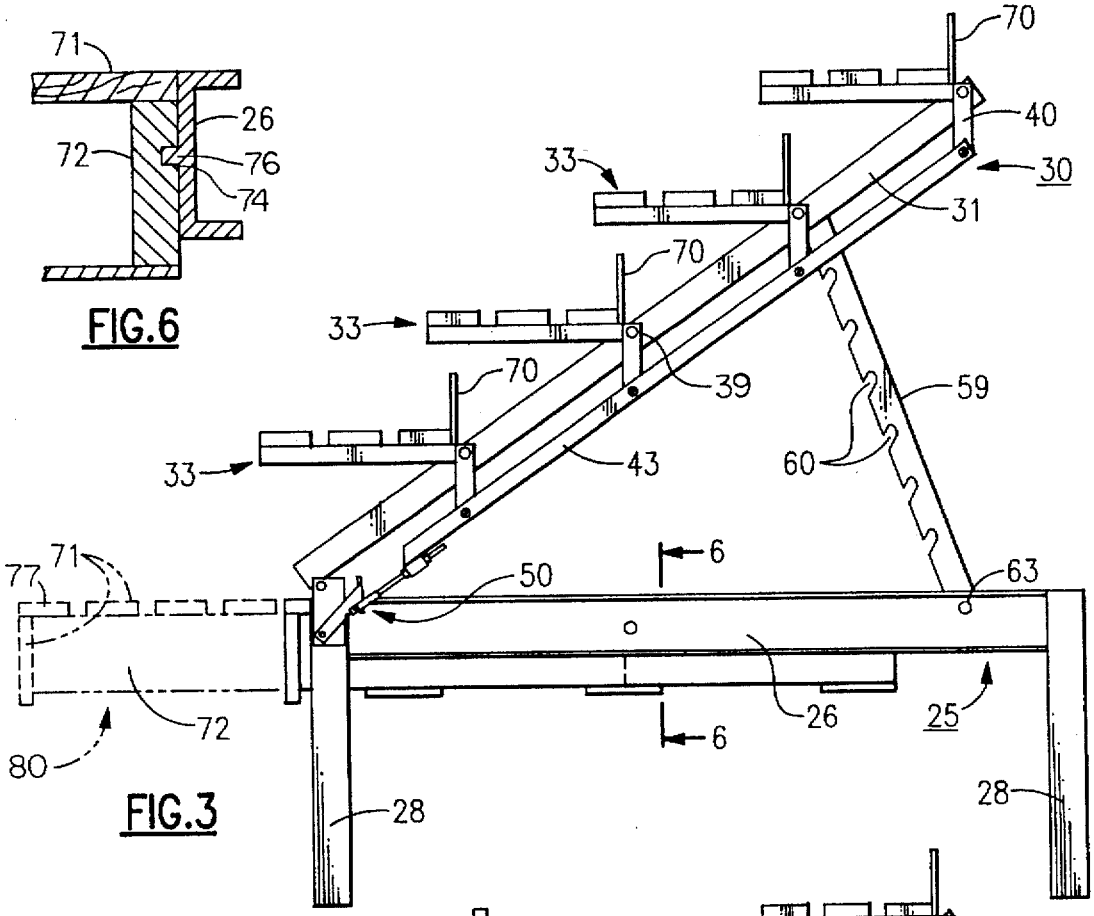
FIG.3
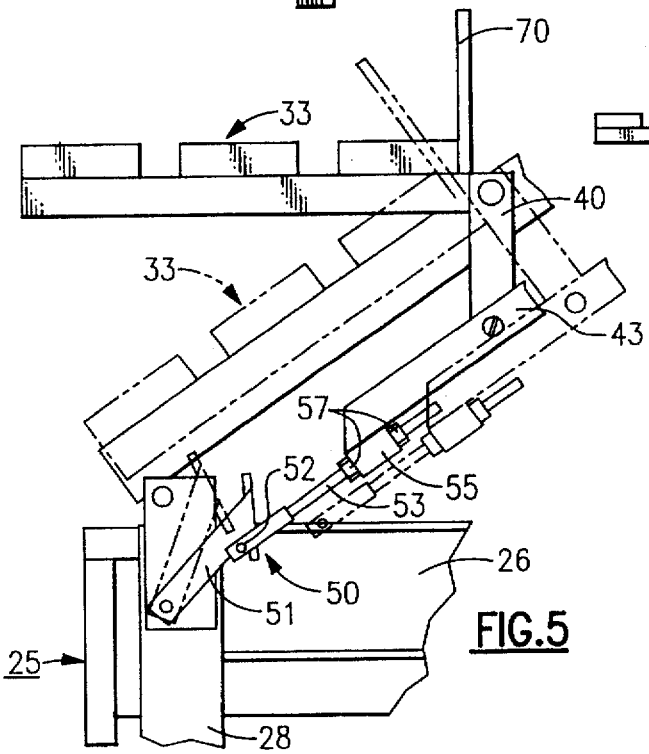
FIG.5
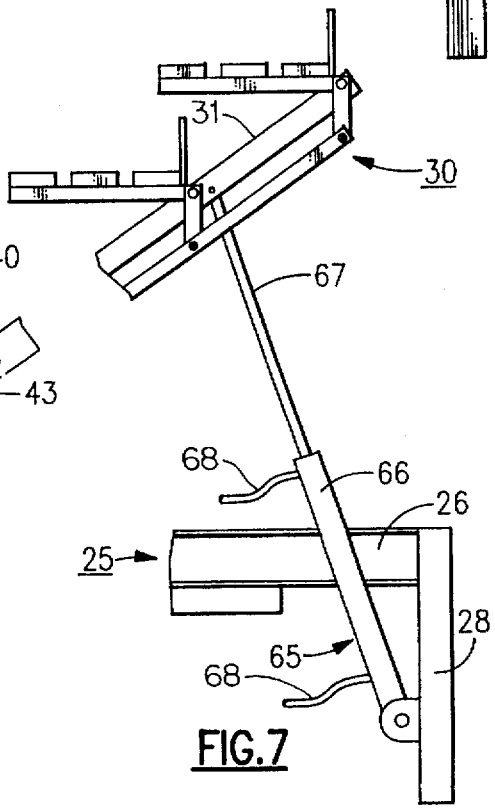
FIG.7

DISPLAY TABLE

BACKGROUND OF THE INVENTION

This invention relates to a table for displaying goods to customers in a retail store and, in particular, to a table for displaying produce such as fresh fruits and vegetables, baked goods and the like, in a grocery department of a retail store.

Heretofore, most fresh fruits and vegetables, baked goods and the like, have been placed on display in stores either in bins or on flat tables. The produce on display is generally difficult to view and equally difficult to access when the goods are located to the back of the display table. Accordingly, unless the goods are constantly repositioned, those toward the back of the display tend not to be selected, go bad, and thus cannot be sold.

In an effort to move goods more efficiently, tables having tiltable tops have been developed which, when tilted upwardly, better display the goods and place the goods in a more advantageous, reachable location for the customers. Although the adjustable tables work quite well in practice, the amount of tilt that can be utilized is limited by the type of produce displayed. For example, when displaying round fruits or vegetables such as apples or oranges, the table is generally placed in a horizontal position. Even while displaying relatively flat fruits or vegetables, the amount of tilt must be relatively slight to prevent the goods from sliding off the table and being damaged.

SUMMARY OF THE INVENTION

It is therefore an object of the present invention to improve display tables used in grocery stores.

It is a still further object of the present invention to provide a display table for goods which contain automatically adjustable shelves which remain in a horizontal position as the table top is tilted into a raised position.

Another object of the present invention is to more effectively display produce, baked goods and the like in a grocery department of a retail store.

These and other objects of the present invention are attained by a display table having a support base and a tiltable top mounted thereon. A series of parallelly aligned shelves are pivotally mounted in the tabletop and are controlled through a latchable linkage mechanism so that the shelves remain in a level, horizontal position as the table is tilted.

BRIEF DESCRIPTION OF THE DRAWINGS

For a better understanding of these and other objects of the present invention, reference will be made to the following detailed description of the invention that is to be read in conjunction with the accompanying drawings wherein:

FIG. 3 is a side elevation showing the present display table in a raised position with the table shelves extended in a horizontally disposed position;

FIG. 5 is a partial enlarged side elevation showing the latching mechanism for actuating a control linkage for holding the shelves in a horizontal position as the table top is raised;

FIG. 6 is a section taken along lines 6—6 in FIG. 3 showing a slide mechanism for supporting a drawer located in the base of the table;

FIG. 7 is an enlarged partial side elevation of the present table showing a hydraulically activated mechanism raising the table top.

DESCRIPTION OF THE INVENTION

Figure 2:
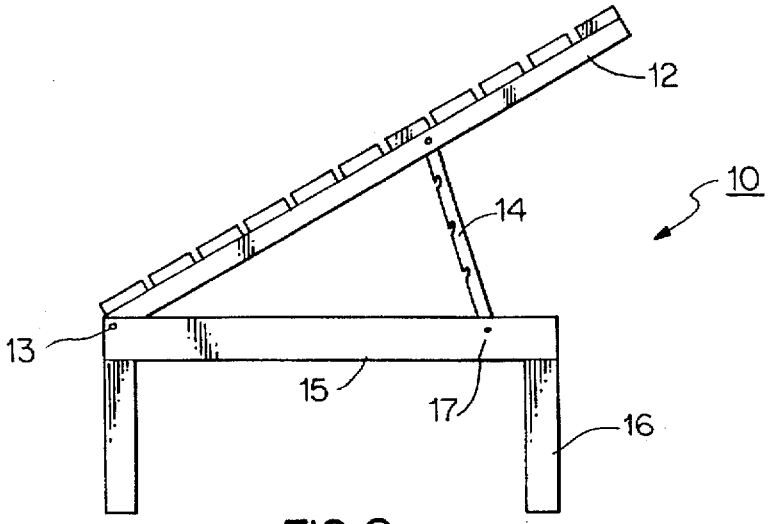
FIG.2 Prior Art
FIG. 2 is a side elevation showing a prior art display table.

Turning initially to FIG. 2, there is shown a prior art display table 10 of the type generally found in the produce department or bakery of a supermarket. The table typically includes a rectangular base 11 for rotatably supporting a flat table top 12. The table top is hinged at one end 13 of the base so that it can be tilted upwardly as shown to display produce mounted thereon. A support stanchion 14 is pivotally mounted in the sidewalls the table top which includes notches to engage a dowel 17 mounted in the base to selectively position the table at various angles of with respect to the base.

As noted above, the prior art tables work well but are limited in use because the displayed goods tend to slide or roll off the table when the table top is tilted beyond a relatively slight angle. Any product that falls from the table becomes damaged and thus, cannot be sold thereby reducing the profitability of the business. Furthermore, items stored at the back of the table are hard to reach and thus do not sell as readily as those located at the front of the table.

Figure 1:
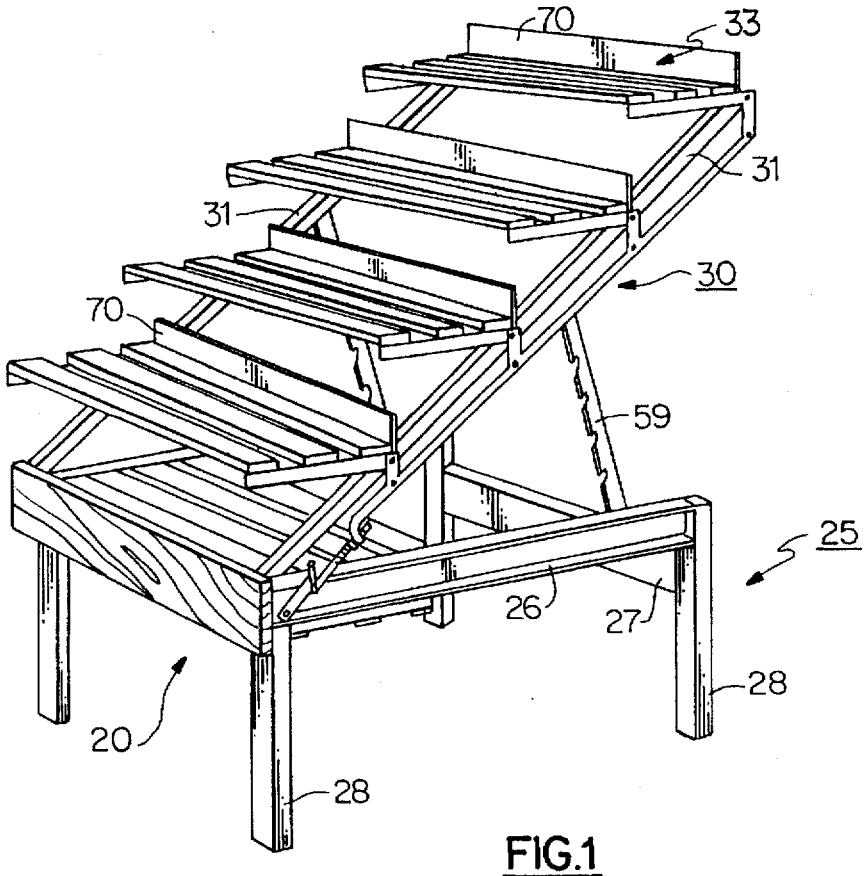
FIG. 1 is a perspective view showing a display table embodying the teaching of the present invention in a raised position.
Figure 4:
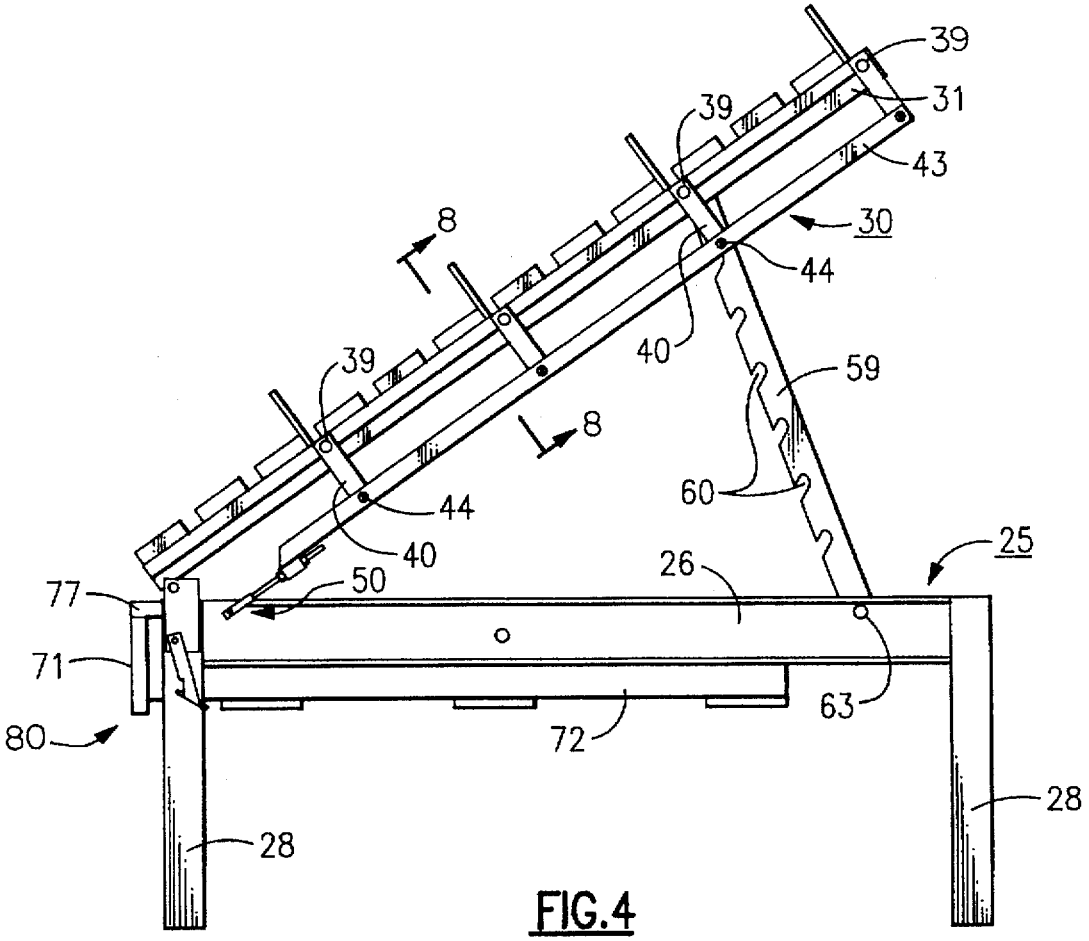
FIG. 4 is also a side elevation showing the present display table in a raised position with the table shelves folded down flat against the tilted table top.

Turning now to the remaining figures and initially to FIG. 1, the table 20 of the present invention is equipped with parallelly aligned shelves, generally referenced 33. As will be explained in greater detail below, the table is equipped with a control linkage that can be selectively engaged or disengaged at the option of the user for controlling the positioning of the shelves. When the control linkage is engaged, the shelves will remain in a horizontal position as the table top is tilted upwardly as shown in FIGS. 1 and 3. When the linkage is disengaged, the shelves will remain closed against the table top as the table is titled upwardly as illustrated in FIG. 4.

The present table contains a rectangular base section 25 having a frame consisting of a pair of stationary side bars 26, end members 27, and upright legs 28—28 for supporting the table on a substrate such as a grocery store floor (not shown). A table top 30 is hinged for rotation in the front of the base so the table can be easily raised to an inclined position as shown to FIG. 1.

The table top 30 consists of a pair of parallel side rails 31, each pivotally supported by pivot pins (not labeled, but similar to that previously described) in the front part of the stationary base 25. A plurality of collapsible shelves 33 are pivotally mounted between the side rails so that the shelves can lie flat against the rails to provide a flat rectangular surface upon which produce such as fruits and vegetables can be displayed.

Figure 8:
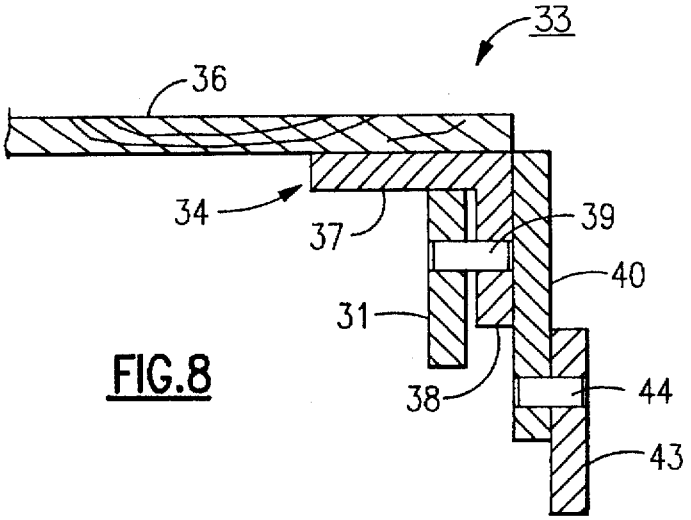
FIG. 8 is a partial sectional view taken along lines 7—7 in FIG. 4 showing the control linkage associated with the table top.

As best illustrated in FIG. 8, each shelf 33 includes a pair of spaced apart end supports 34—34 which are angle irons having a horizontal leg 37 and a vertical leg 38. A series of spaced apart parallelly aligned wooden slats 36 are mounted upon the horizontal legs of the opposed end supports and are secured to the horizontal legs by any suitable means such as countersink screws on the like. The vertical leg of each end support is pivotally mounted in an adjacent side rail 31 by means of a pivot pin 39. Accordingly, each shelf can be tilted upwardly with respect to the front of the table top.

A rocker arm 40 is secured to the vertical leg of each end support by any suitable means so that the arm is substantially perpendicularly aligned with the horizontal leg of the support. The bottom portion of each rocker arm, in turn, is pivotally connected to a common control bar 43 by means of a pivot pin 44 so that each of the rocker arms are caused to rotate in unison when the control bar is displaced laterally beneath the table top.

Each control bar can be connected and disconnected from the base of the display table by means of an adjustable latching mechanism generally referenced 50 (FIG. 5). The latching mechanism includes a latch 51 that is rotatably retained to a front leg of the base. The latch is arranged to engage a latch pin 52 carried on the end of a threaded stud 53. The stud, in turn, is threaded into a housing 56 secured to the bottom of the control bar. The stud is held in a desired position by means of a pair of lock nuts 57 that close against the housing. The position of the control bar is set when the latch is engaged by adjusting the stud 53 within the housing 55. As shown in FIG. 4, when the latching mechanism 50 is disengaged, the shelves will lie flat against the rails as the table top is tilted between a horizontal position and the fully raised position, as illustrated. Engaging the latching mechanism, as shown in FIG. 3, pivotally attaches the control bar to the stationary table base, thus holding the shelves through means of the rocker arms in a horizontal posture, despite the position of the table top. Accordingly, the present display table can be selectively positioned to display a wide variety of goods to most effectively present the goods to a customer.

A pair of stanchions 59 having a series of notches 60 are hinged in the two side rails of the table top (FIG. 1). The notches are arranged to mate with dowels 63 mounted in the frame of the base. The tilt of the table top can thus be set to a desired position by selectively mounting an appropriate notch in mating engagement with the dowel. As should be evident from the disclosure above, with the latching mechanism engaged, the individual shelves will be held in a level horizontal position by the linkage mechanism as the tilted position of the table top is changed from one notch position to another.

The adjustable stanchions may be replaced by a hydraulic or pneumatic actuator 65 shown in FIG. 7. The actuator includes a double acting cylinder 66 containing a piston rod 67. The lower end of the cylinder is pinned to a rear leg of the base and the distal end of the piston rod is similarly pinned to one of the table top side rails. Fluid is exchanged via lines 68 to either side of a piston contained in the cylinder to selectively raise or lower the table top and thus set the table top at a desired position within the range of the cylinder.

A transparent plastic back plate 70 is attached to the rear slat of each shelf. The back plate is raised some distance above the floor of each shelf and thus prevents produce from falling off the back of the shelf when the shelves am being maintained in a horizontal position as illustrated in FIG. 3. Additionally, the back plates serve as stops to prevent produce from sliding down a tilted table top when the shelves are lying flat upon the side rails 31 as illustrated in FIG. 4.

A pull out drawer generally referenced 80 is slidably contained in the base so that it opens and closes at the front of the base. The drawer contains a front panel 71 and a pair of side panels 72. As illustrated in FIG. 6, each side panel contains a groove 74 that extends along its length that is adapted to slidably engage a tongue 76 mounted on the inside of each side bar 26 and thus support the drawer in the base. Spaced apart parallelly aligned wooden slats 77 are secured to the top of each side panel for supporting further produce when the drawer 80 is extended as shown in phantom outline in FIG. 3.

While this invention has been explained with reference to the structure disclosed herein, it is not confined to the details set forth mad this invention is intended to cover any modifications and changes as may come within the scope of the following claims:

What is claimed is:

1. A display table for produce and the like comprising:

a stationary base having a front end and a back end;

a movable table top that is rotatably supported to the front end of said base so that the table top can be tilted from a horizontal position to a raised position;

said movable table top further including a pair of spaced apart parallel side rails and a plurality of flat shelves mounted in alignment between said side rails;

each of said shelves being rotatably mounted at one end by pivot means to said side rails so that the plurality of shelves lie flat against the rails when the table top is in the horizontal position and can be angularly disposed in relation to said rails when the table top is raised to the tilted position; and linkage means connectable to each of said plurality of shelves to maintain said shelves in a horizontal position when the table top is raised into the tilted position;

said linkage means further including at least one rocker arm attached to each of said plurality of shelves for rotating each said shelf about said pivot means and a common control bar for uniformly acting on each said rocker arm to selectively move said plurality of shelves between the horizontal and the flat position, wherein each of said rocker arms is maintained in perpendicular alignment with a corresponding horizontal leg of each said shelf.

2. The display table of claim 1, including latching means operable to connect and disconnect said control bar to and from said base so that said shelves lie flat against said side rails when said control bar is disconnected from said base and are maintained in the horizontal position when said control bar is connected to said base.

3. A display table for retaining produce and the like comprising:

a stationary base having a front end and a back end;

a movable table top pivotally supported to the front end of said stationary base to allow said table top to be tilted between a horizontal position and an inclined position relative to said base, said table top including a pair of parallel side rails and a plurality of flat shelves mounted on opposite ends to said side rails, each of said plurality of shelves being pivotally mounted by pivot means to said side rails such that said shelves lie flat against the rails when the table top is in the horizontal position and can be angularly disposed in relation to said rails when said table top is raised to the inclined position;

linkage means for maintaining said plurality of shelves in a horizontal position when said table top is raised to the inclined position, said linkage means including a rocker arm attached to each of said plurality of shelves for rotating said shelves about said pivot means, and a common control bar for uniformly acting on said rocker arms of said shelves; and latching means for connecting and disconnecting said common control bar to and from said base such that said shelves lie flat against said side rails when said control bar is disconnected from said base and said shelves are maintained in the horizontal position when said common control bar is connected to said base, said latching means including a latch, a latch pin engageable with said latch for connecting said base, and adjustment means for adjusting the position of said control bar relative to said base.

4. The display table of claim 3, wherein said base includes legs for supporting said base upon a substrate.

5. The display table of claim 3, including a slidable drawer contained within said base and extendable outwardly from the front end.

6. The display table of claim 5, wherein said drawer includes a rack upon which produce and the like can be displayed.

7. The display table of claim 3, including at least one stanchion for selectively adjustably positioning the table top at variable angles with respect to said base.

8. The display table of claim 3, including tilting means extending between said base and the table top for selectively raising and lowering said table top to a desired position.

9. The display table of claim 8, wherein said tilting means includes a pneumatic cylinder.

10. The display table of claim 8, wherein said tilting means includes a hydraulic cylinder.

11. The display table of claim 3, wherein each of said plurality of shelves includes a pair of end supports pivotally mounted to said side rails and spaced apart slats mounted upon said end supports.

12. The display table of claim 11, wherein said slats are made of wood.

13. The display table of claim 3, wherein each of said shelves includes a raised back member extending across the back of each shelf.

14. The display table of claim 13, wherein said back member is formed from a transparent plastic.

* * * * *